US011111795B2

(12) United States Patent
Lee et al.

(10) Patent No.: US 11,111,795 B2
(45) Date of Patent: Sep. 7, 2021

(54) TURBINE ROTOR AIRFOIL AND CORRESPONDING METHOD FOR REDUCING PRESSURE LOSS IN A CAVITY WITHIN A BLADE

(71) Applicant: Siemens Aktiengesellschaft, Munich (DE)

(72) Inventors: Ching-Pang Lee, Cincinnati, OH (US); Harry Holloman, Maineville, OH (US); Steven Koester, Toledo, OH (US); Jae Y. Um, Winter Garden, FL (US); Sin Chien Siw, Oviedo, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/640,806

(22) PCT Filed: Aug. 7, 2018

(86) PCT No.: PCT/US2018/045494
§ 371 (c)(1),
(2) Date: Feb. 21, 2020

(87) PCT Pub. No.: WO2019/040272
PCT Pub. Date: Feb. 28, 2019

(65) Prior Publication Data

US 2021/0025278 A1 Jan. 28, 2021

Related U.S. Application Data

(60) Provisional application No. 62/549,716, filed on Aug. 24, 2017.

(51) Int. Cl.
*F01D 5/18* (2006.01)

(52) U.S. Cl.
CPC ..... *F01D 5/187* (2013.01); *F05D 2260/205* (2013.01); *F05D 2270/301* (2013.01)

(58) Field of Classification Search
CPC . F01D 5/08; F01D 5/185; F01D 5/186; F01D 5/187; F01D 25/08; F01D 25/12;
(Continued)

(56) References Cited

U.S. PATENT DOCUMENTS 4,604,031 A * 8/1986 Moss ..... F01D 5/187 416/97 R
5,073,086 A * 12/1991 Cooper ..... F01D 5/187 416/96 R
(Continued)

FOREIGN PATENT DOCUMENTS

EP 3465004 A2 1/1992
EP 2299058 A2 3/2011
(Continued)

OTHER PUBLICATIONS

PCT International Search Report and Written Opinion dated Nov. 2, 2018 corresponding to PCT Application No. PCT/US2018/045494 filed Aug. 7, 2018.

*Primary Examiner* — Igor Kershteyn

(57) ABSTRACT

A blade airfoil for a turbine engine that includes an internal multiple pass serpentine flow cooling circuits with a leading edge circuit and a trailing edge circuit. The entrance of a cavity in the leading edge circuit has a narrowing of a cavity width that expands further downstream to a consistent cavity width similar to the cavity width of the rest of the leading edge circuit.

9 Claims, 4 Drawing Sheets

(58) Field of Classification Search
CPC .. F01F 5/18; F05D 2250/73; F05D 2250/185; F05D 2260/205; F05D 2270/301
See application file for complete search history.

(56) References Cited

U.S. PATENT DOCUMENTS

| | | | | |
|---|---|---|---|---|
| 5,536,143 | A * | 7/1996 | Jacala | F01D 5/187 416/96 R |
| 6,036,440 | A * | 3/2000 | Tomita | F01D 5/187 415/114 |
| 6,595,750 | B2 * | 7/2003 | Parneix | F01D 5/187 416/97 R |
| 7,674,093 | B2 * | 3/2010 | Lee | B22C 9/103 416/97 R |
| 2005/0281674 | A1 * | 12/2005 | Liang | F01D 5/187 416/97 R |
| 2013/0343872 | A1 | 12/2013 | Tibbott et al. | |
| 2014/0286790 | A1 | 9/2014 | Molter et al. | |
| 2015/0110639 | A1 | 4/2015 | Herzlinger et al. | |
| 2017/0058678 | A1 * | 3/2017 | Lee | F01D 5/147 |
| 2021/0087937 | A1 | 3/2021 | Pöhler et al. | |

FOREIGN PATENT DOCUMENTS

| | | | |
|---|---|---|---|
| EP | 3798416 | A1 | 3/2021 |
| JP | 2004132218 | A | 4/2004 |
| JP | 5357601 | B2 | 12/2013 |

* cited by examiner

TURBINE ROTOR AIRFOIL AND CORRESPONDING METHOD FOR REDUCING PRESSURE LOSS IN A CAVITY WITHIN A BLADE

BACKGROUND

1. Field

The present invention relates to turbine blades for a gas turbine and, more particularly, to an asymmetrically shaped turbine blade internal tip turn.

2. Description of the Related Art

In an industrial gas turbine engine, hot compressed gas is produced. A combustion system receives air from a compressor and raises it to a high energy level by mixing in fuel and burning the mixture, after which products of the combustor are expanded through the turbine.

The hot gas flow is passed through a turbine and expands to produce mechanical work used to drive an electric generator for power production. The turbine generally includes multiple stages of stator vanes and rotor blades to convert the energy from the hot gas flow into mechanical energy that drives the rotor shaft of the engine. Turbine inlet temperature is limited by the material properties and cooling capabilities of the turbine parts. This is especially important for first stages of turbine blades and vanes since these airfoils are exposed to the hottest gas flow in the system.

Since the turbine blades are exposed to the hot gas flow discharged from combustors within the combustion system, cooling methods are used to obtain a useful design life cycle for the turbine blade. Blade cooling is accomplished by extracting a portion of the cooler compressed air from the compressor and directing it to the turbine section, thereby bypassing the combustors. After introduction into the turbine section, this cooling air flows through passages or channels formed in the airfoil portions of the blades.

Gas turbines are becoming larger, more efficient, and more robust. Large blades and vanes are being produced, especially in a hot section of the engine system with higher temperatures. The blades, therefore, require significant cooling to maintain an adequate component life.

SUMMARY

In one aspect of the present invention, a turbine rotor airfoil comprises: a leading edge and a trailing edge joined by a pressure side and a suction side, a tip end, and a radially opposite root end; and at least two multiple pass serpentine flow cooling circuits formed within the airfoil to provide cooling for the airfoil comprising; a leading edge circuit comprising at least a first forward direction cavity located within the airfoil and a second forward direction cavity axially forward of the first forward direction cavity, wherein the leading edge circuit flows forward with at least two substantially 180-degree turns at the tip end and the root end of the airfoil providing at least a penultimate forward direction cavity and a last forward direction cavity, wherein the last forward direction cavity is located along the leading edge of the airfoil; and a trailing edge circuit comprising at least a first aft direction cavity located aft of the first forward direction cavity, wherein the trailing edge circuit flows aft with at least two substantially 180-degree turns at the tip end and the root end of the airfoil providing at least a penultimate aft direction cavity and a last aft direction cavity, wherein the last aft direction cavity is located along the trailing edge of the airfoil; wherein the 180-degree turn into the entrance of the second forward direction cavity from the exit of the first forward direction cavity narrows from a consistent cavity width and then expands out back to the consistent cavity width downstream with a consistent diameter between the two cavities.

In another aspect of the present invention, a method for reducing pressure loss in a forward direction cavity within a blade for a turbine engine, the method comprises: reducing a cavity width at an entrance of a radially inward flowing cavity of a forward direction leading edge circuit of at least two multiple pass serpentine flow cooling circuits formed within the airfoil; increasing the diameter of the space between the radially inward flowing cavity and a radially outward flowing cavity at the point of the entrance into the radially inward flowing cavity to a maximum diameter length.

These and other features, aspects and advantages of the present invention will become better understood with reference to the following drawings, description and claims.

BRIEF DESCRIPTION OF THE DRAWINGS

The invention is shown in more detail by help of figures. The figures show preferred configurations and do not limit the scope of the invention.

DETAILED DESCRIPTION

Figure 1:
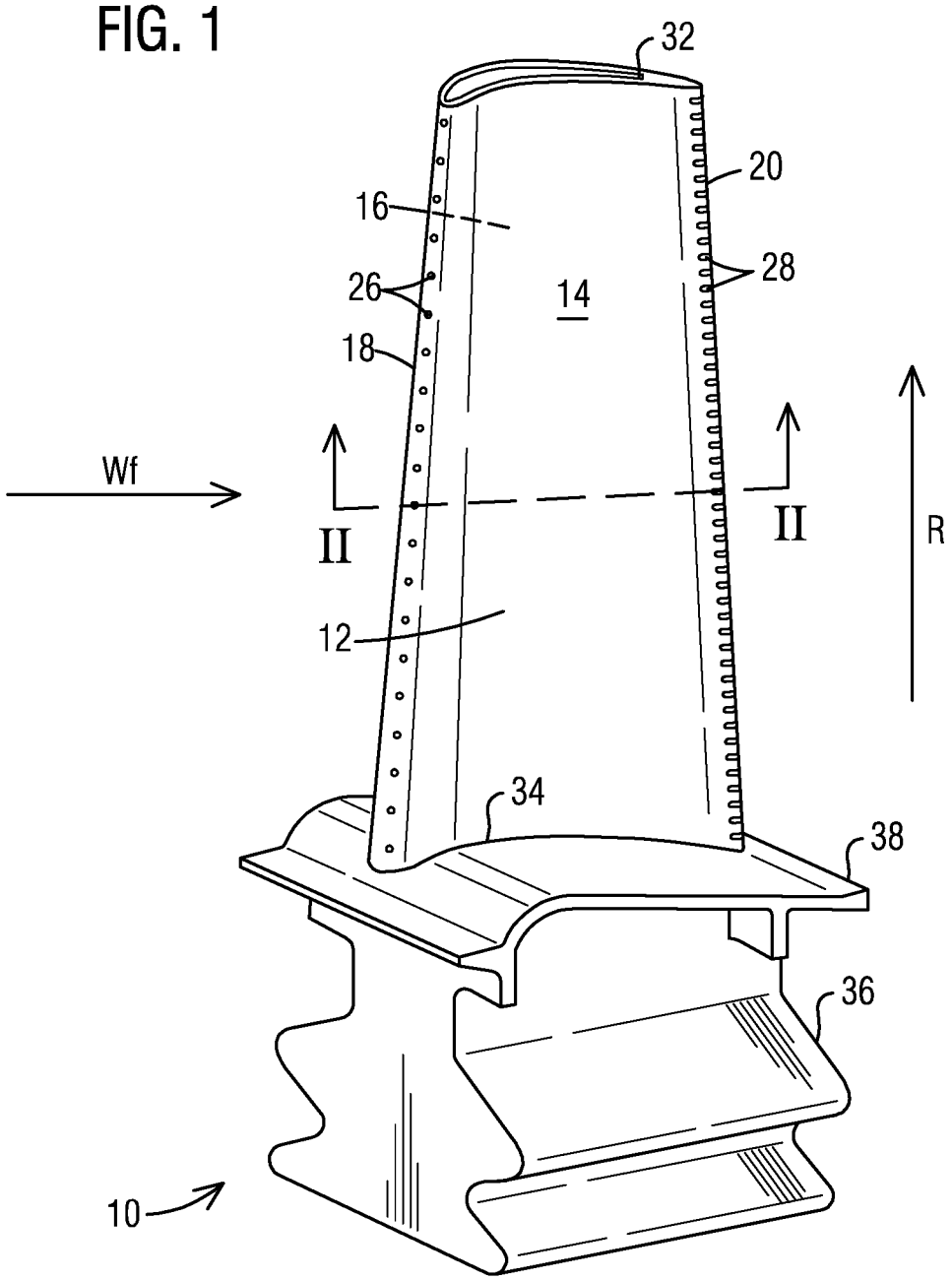
FIG. 1 is an perspective pressure side view of a turbine blade according to an exemplary embodiment of the present invention.

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Broadly, an embodiment of the present invention provides a blade airfoil for a turbine engine that includes an internal multiple pass serpentine flow cooling circuits with a leading edge circuit and a trailing edge circuit. The entrance of a cavity in the leading edge circuit has a narrowing of a cavity width that expands further downstream to a consistent cavity width similar to the cavity width of the rest of the leading edge circuit.

A gas turbine engine may comprise a compressor section, a combustor and a turbine section. The compressor section compresses ambient air. The combustor combines the compressed air with a fuel and ignites the mixture creating combustion products comprising hot gases that form a working fluid. The working fluid travels to the turbine section. Within the turbine section are circumferential alternating rows of vanes and blades, the blades being coupled to a rotor. Each pair of rows of vanes and blades forms a stage in the turbine section. The turbine section comprises a fixed turbine casing, which houses the vanes, blades and rotor.

In certain embodiments, air for cooling the rotor and rotating blades may be extracted from the axial compressor discharge at a combustor shell. The compressor discharge air may pass through an air-to-air cooler and may be filtered for rotor cooling. Direct cooling may occur at the turbine spindle blade root end along one or more stages. The turbine stationary vanes may be cooled by both internal bypassing and external bleeding lines.

An effective step that can be taken to increase the power output and improve the efficiency of a gas turbine engine may be to increase the temperature at which heat is added to the system, that is, to raise the turbine inlet temperature of the combustion gases directed to the turbine. Increases in efficient turbines have led to an increase in the temperature that must be withstood by the turbine blades and rotor. The result is that to use the highest desirable temperatures, some form of forced cooling may be desirable. This cooling may be in the form of air bled from the compressor at various stages, and ducted to critical elements in the turbine. Although emphasis is placed on cooling the initial stages of vanes and blades, air may be also directed to other vanes, blade rings and discs.

Because the airfoil is subjected to these high temperatures and pressures, it is very difficult to maintain an acceptable metal temperature. A forward direction serpentine circuit is desired. However, the pressure drops in the forward direction prevent a reliable cooling method to be efficient. A reduction in pressure loss and fluid separation through a more effective cooling system is desirable. Embodiments of the present invention provide a blade that may allow for the reduction in pressure loss specifically at a turn in the serpentine circuit.

Referring now to FIG. 1, a turbine airfoil 10 is illustrated according to one embodiment. As illustrated, the turbine airfoil 10 is a turbine blade for a gas turbine engine. It should however be noted that aspects of the invention could additionally be incorporated into stationary vanes in a gas turbine engine. The airfoil 10 may include an outer wall 12 adapted for use, for example, in a high pressure stage of an axial flow gas turbine engine. The outer wall 12 delimits an airfoil interior 52. The outer wall 12 extends span-wise along a radial direction R of the turbine engine and includes a generally concave shaped pressure sidewall 14 and a generally convex shaped suction sidewall 16. The pressure sidewall 14 and the suction sidewall 16 are joined at a leading edge 18 and at a trailing edge 20. The outer wall 12 may be coupled to a root 36 at a platform 38. The root 36 may couple the turbine airfoil 10 to a disc (not shown) of the turbine engine. The outer wall 12 is delimited in the radial direction by a radially outward airfoil end face (airfoil tip cap) 32 and a radially inward airfoil end face 34 coupled to the platform 38. In other embodiments, the turbine airfoil 10 may be a stationary turbine vane with a radially inward end face coupled to the inner diameter of the turbine gas path section of the turbine engine and a radially outward end face coupled to the outer diameter of the turbine gas path section of the turbine engine.

Figure 2:
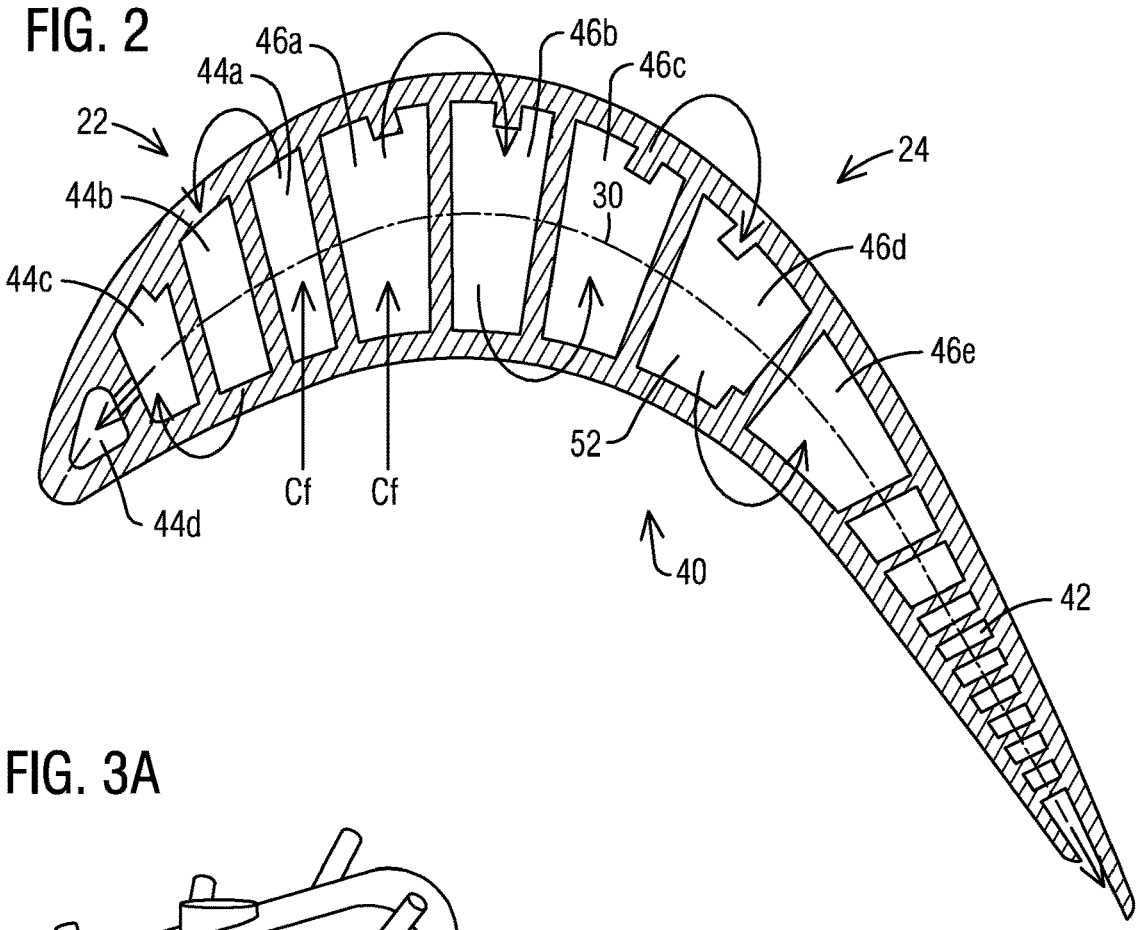
FIG. 2 is a cross sectional top view of a cooling circuit of an exemplary embodiment of the present invention.

Referring to FIG. 2, a chordal axis 30 may be defined extending centrally between the pressure sidewall 14 and the suction sidewall 16. In this description, the relative term "forward" refers to a direction along the chordal axis 30 toward the leading edge 18, while the relative term "aft" refers to a direction along the chordal axis 30 toward the trailing edge 20. As shown, cooling circuits 40 of internal passages are formed by radial coolant cavities 44*a-d*, 46*a-e* between the pressure sidewall 14 and the suction sidewall 16 along a radial extent. In the present example, cooling fluid Cf may enter one or more of the radial cavities 44*a-d*, 46*a-e* via openings provided in the root end 34 of the blade 10, from which the cooling fluid Cf may traverse into adjacent radial coolant cavities, for example, via two or more serpentine cooling circuits 40. Having traversed the radial coolant cavities 44*a-d*, 46*a-e*, the cooling fluid Cf may be discharged from the airfoil 10 into a working fluid hot gas path Wf, for example via exhaust orifices 26, 28 located along the leading edge 18 and the trailing edge 20 respectively as shown in FIG. 1. Although not shown in the drawings, exhaust orifices 26, 28 may be provided at multiple locations, including anywhere on the pressure sidewall 14, the suction sidewall 16, and the airfoil tip 32.

The last aft radial coolant cavity 46*e* is the closest coolant cavity to the trailing edge 20. Upon reaching the last aft radial coolant cavity 46*e*, the cooling fluid Cf may exit the last aft radial coolant cavity 46*e* and traverse axially through an internal arrangement of trailing edge cooling features 42, located along the trailing edge 20, before leaving the airfoil 10 via cooling fluid exhaust orifices 28 arranged along the trailing edge 20.

As is illustrated in FIGS. 2 through 5B, the turbine rotor airfoil 10 may include at least two cooling circuits 40, a leading edge circuit 22 and a trailing edge circuit 24. Each cooling circuit 40 may include separate entrances to form at least two cooling air streams. The leading edge circuit 22 includes forward direction cavities 44 with at least some of the forward direction cavities 44 following in a serpentine style path that may include a first radial coolant cavity (44, 46) flowing forward into a second radial coolant cavity (44, 46) i.e. a first forward direction cavity 44*a* flowing forward into a second forward direction cavity 44*b*. The entrance to the leading edge circuit 22 may pass through the first forward direction cavity 44*a*. Cooling fluid Cf may enter into the first forward direction cavity 44*a* and flow forward into the second forward direction cavity 44*b* through a substantially 180-degree tip turn 58 at the tip end 32 of the airfoil 10. The serpentine style path may continue until a penultimate forward direction cavity 44*c*. Passing through into the penultimate forward direction cavity 44*c*, the cooling fluid Cf may then impinge into the last forward direction cavity 44*d* through a direct chordal axis 30.

The trailing edge circuit 24 may include a serpentine style path that may include multiple pass cooling channels, also referred to as aft direction cavities 46. In certain embodiments, there is a 3-pass serpentine cooling circuit. In certain embodiments, there is a 5-pass serpentine cooling circuit. In certain embodiments, there is a 7-pass serpentine cooling circuit. The trailing edge circuit 24 includes a first aft direction cavity 46*a*. The entrance to the trailing edge circuit 24 may pass through the first aft direction cavity 46*a* and is aft of the forward direction cavities 44. Cooling fluid Cf may enter into the a first radial coolant cavity (44, 46) flowing aft into a second radial coolant cavity (44, 46) i.e. a first aft direction cavity 46*a* and flow aft into the second aft direction cavity 46*b* through a substantially 180-degree tip turn 58 at the tip end 32 of the airfoil 10. The trailing edge circuit 24 may also include at least a penultimate aft direction cavity 46*d* and a last aft direction cavity 46*e*.

The multiple pass cooling circuits 40 help move flow of cooling fluid Cf from within the airfoil 10 towards both the leading edge 18 and the trailing edge 20 in order to help reduce the blade temperature throughout the blade 10.

The multiple forward direction cavities 44 of the leading edge circuit 22 are connected through at least two substantially 180-degree turns along the tip end 32 and the root end 34 of the blade airfoil 10 that change the direction of cooling fluid Cf through the multiple forward direction cavities 44 as the cooling fluid Cf moves forward. The multiple aft direction cavities 46 of the trailing edge circuit 24 are connected through at least two substantially 180-degree turns along the tip end 32 and the root end 34 of the blade airfoil 10 that change the direction of cooling fluid Cf through the multiple aft direction cavities 46 as the cooling fluid Cf moves aft. Within the leading edge circuit 22, the last forward direction cavity 44*d* may be located along the leading edge 18 of the blade 10. The penultimate forward direction cavity 44*c* is positioned aft of the last forward direction cavity 44*d* and may only flow forward, impinging directly into the last forward direction cavity 44*d*. The trailing edge circuit 24 flows aft from the first aft direction cavity 46*a* with at least two substantially 180-degree turns at the tip end 32 and the root end 34 of the blade 10 towards the penultimate aft direction cavity 46*d* and the last aft direction cavity 46*e*. The last aft direction cavity 46*e* may be located along the trailing edge 20 of the blade 10.

The flow of the cooling fluid Cf through the substantially 180-degree turns at the tip end 32 and the root end 34 of the airfoil 10 is important as to how the cooling fluid pressure is preserved through cooling circuits 40. Below, the first forward direction cavity 44*a* and the second forward direction cavity 44*b* will be the focus of discussion as an example of the embodiments disclosed herewith. The leading edge circuit is more sensitive to the pressure loss than the trailing edge circuit. However, embodiments herein can be applied to any flow turning in the serpentine cooling circuit whether in the leading edge direction or the trailing edge direction. As is shown in FIGS. 3A through 5B the conventional cavity turn is shown as 3A, 4A, and 5A versus improvements shown in FIGS. 3B, 4B, and 5B. In general, the cavities have a consistent cavity width 48 as each cavity runs inward and outward radially. Space between each cavity generally has a consistent diameter 50 to match the consistent cavity width 48. Conventionally, there is a smooth arc that runs at the end of each space between cavities before turning into the next cavity. At each tip turn 58 of the radial coolant cavities 44*a-d*, 46*a-e* there is an exit 56 of the cavity the cooling fluid Cf is leaving, and an entrance 54 of the next cavity that the cooling fluid Cf is entering. The 180 degree tip turn 58 is a smooth transition from the first forward direction cavity 44*a* to the second forward direction cavity 44*b* as an example. Embodiments below include a change to the structure of the tip turn 58 of the cavities.

The temperature of the blade 10 increases near the end of the trailing edge circuit 2, along the tip end 32, and along the leading edge 18 of the blade 10. Changing the shape of the cavity end to an asymmetrically shaped tip turn 58 can positively affect the cooling fluid Cf pressure as it enters the second forward direction cavity 44*b*, for example. Flow separation and pressure losses can be reduced within the second forward direction cavity 44*b*. This reduction in losses in turn, can improve back-flow-margin at the leading edge circuit 22 while using a multi-pass serpentine cooling circuit 40 for better cooling efficiency and lower cooling flow requirements.

Figure 3A:
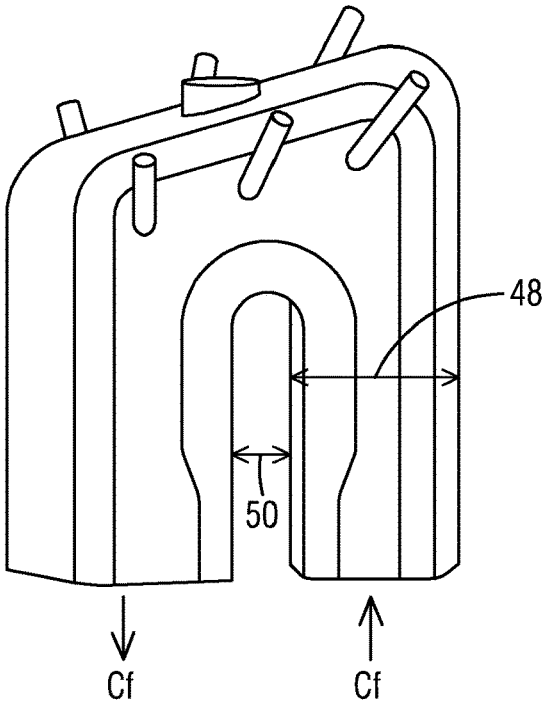
FIGS. 3A and 3B are detailed views of a turbine blade airfoil cooling circuit according to prior art and an exemplary embodiment of the present invention respectively.
Figure 3B:
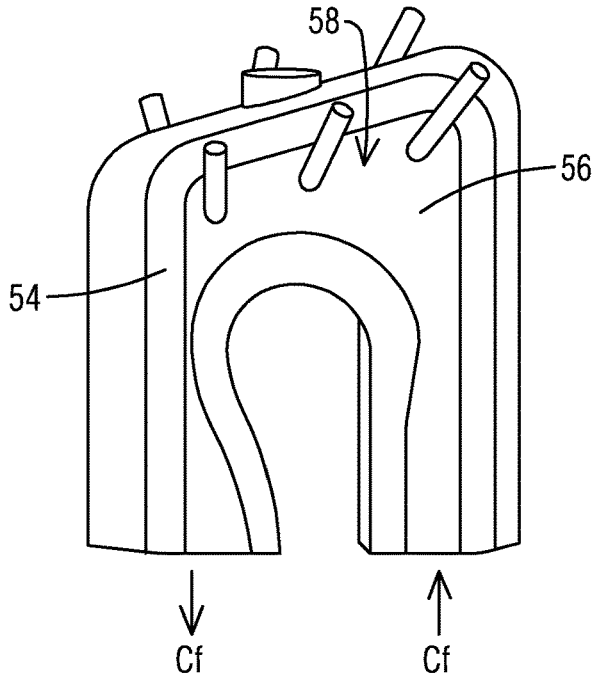

FIGS. 3A and 3B show the details of the tip turn for the first forward direction cavity to the second forward direction cavity 44*b*. As can be seen, the exit 56 from the first forward direction cavity 44*a* flows forward into the entrance 54 of the second forward direction cavity 44*b*. In certain embodiments, as the tip turn 58 moves into the entrance 54 of the second forward direction cavity 44*b*, the cavity narrows from a consistent cavity width 48 at the point of entrance 54. The cavity width 48 then expands out back to the consistent cavity width 48 downstream of the entrance 54. As the cavity width 48 narrows, the diameter 50 between the two cavities expands, and then is reduced again downstream to the consistent diameter 50 from before. This expansion of the diameter 50 reaches a maximum diameter length.

In certain embodiments, the diameter 50 of the space between the first forward direction cavity 44*a* and the second forward direction cavity 44*b* expands out at the entrance 54 of the second forward direction cavity 44*b* to approximately twice the size of the diameter 50 than that of the consistent diameter 50 along the rest of the space between the cavities.

The maximum diameter length transitions down to the consistent diameter length at some point downstream of the entrance 54 of the second forward direction cavity 44*b*. In certain embodiments, the transition of the diameter 50 length occurs over an angle less than approximately fifteen degrees from the maximum diameter length making a smooth transition from the maximum diameter length to the original consistent diameter length.

Figure 4B:
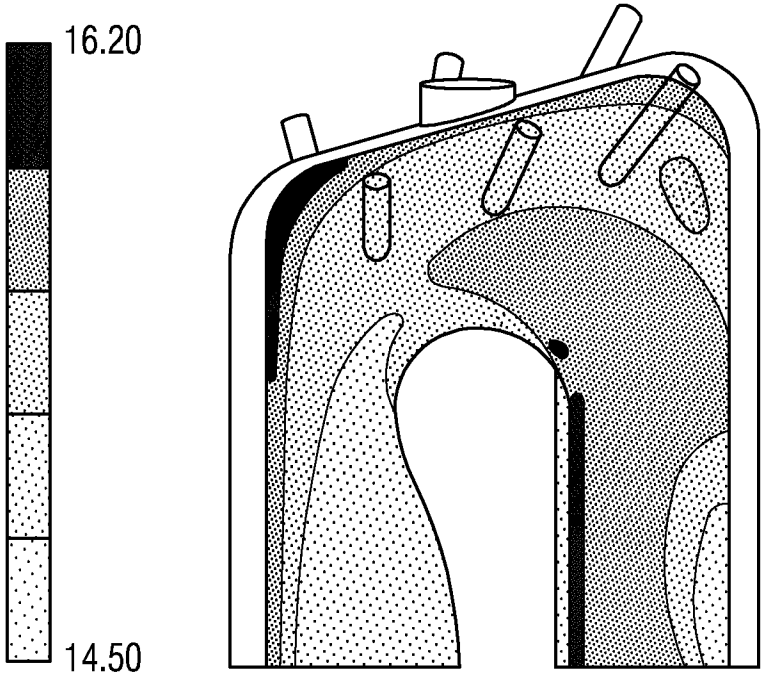
FIGS. 4A and 4B are a partial detailed cross-sectional view of a turbine blade cooling circuit according to prior art and an exemplary embodiment of the present invention respectively.
Figure 4A:
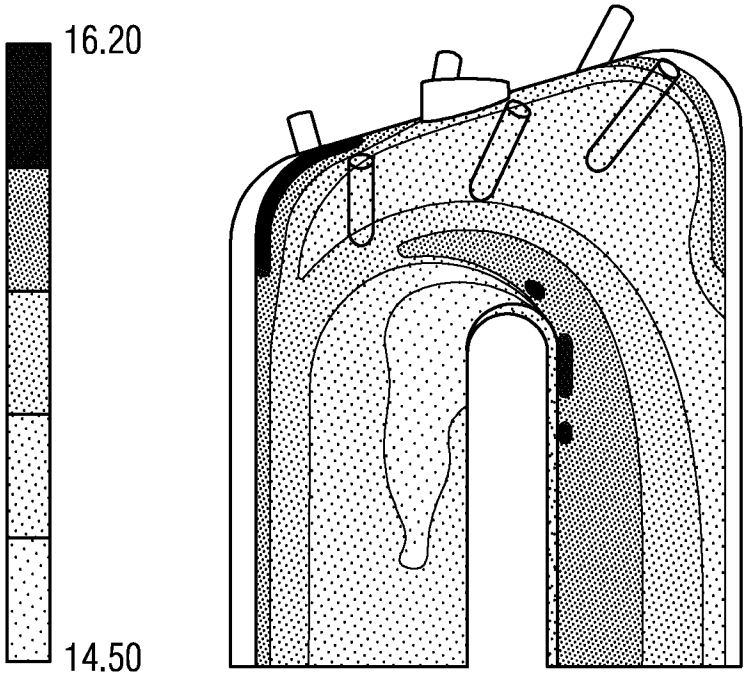

FIG. 4A shows that conventional tip turn geometry creates an increased pressure drop on a near side of the cavity along the entrance of the cavity in a radially inward direction. Further, FIG. 4B shows the pressure distribution at the exit of a radially outward direction shows a more uniform reduced pressure loss with the asymmetrical tip turn 58. The pressure drop is reduced with the asymmetrical tip turn 58. By removing the area of the cavity that provided the most pressure drop at the turn and narrowing the space that the cooling fluid enters, a more even distribution of pressure is created. The decrease in pressure drop is important as a multiple-pass serpentine forward cooling circuit is designed. Here in FIG. 4B, the cavity width 48 is reduced at the entrance 54 of the radially inward flowing cavity and the diameter 50 of the space between the radially inward flowing cavity and the radially outward flowing cavity is increased.

Figure 5B:
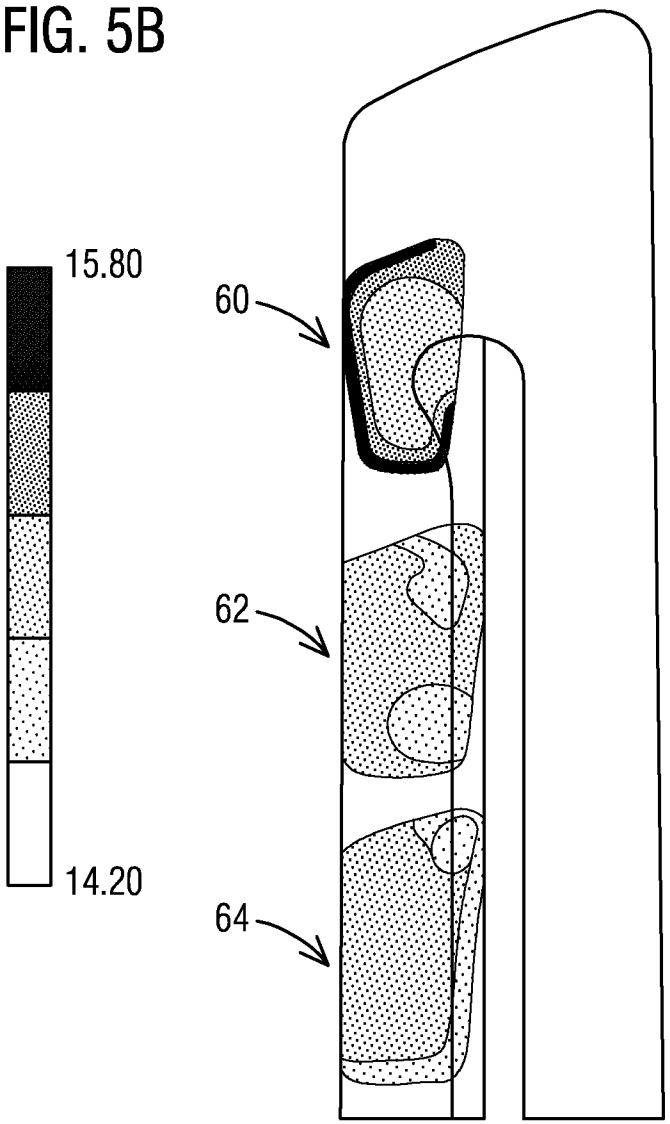
FIGS. 5A and 5B are cross sectional views of a cooling circuit of the prior art and an exemplary embodiment of the present invention respectively.
Figure 5A:
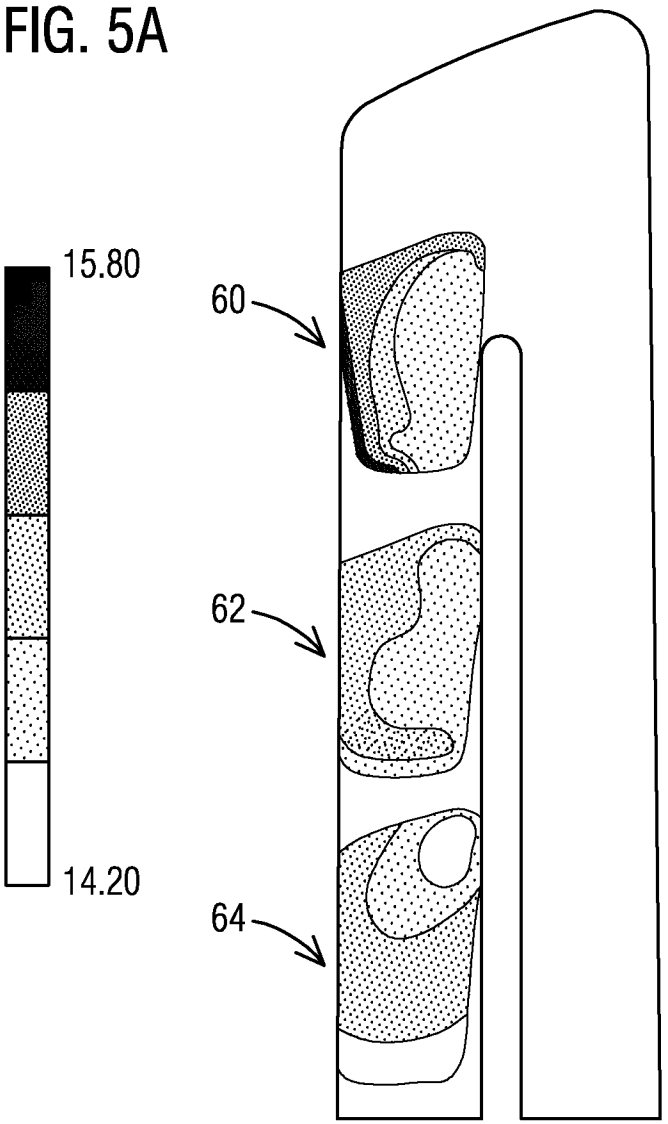

FIGS. 5A and 5B show that the flow distribution in the radially inward pass after the turn is much more uniform than the conventional design with symmetrical cavities. Low pressure regions within various sections 60, 62, 64 are reduced or eliminated with the change in the geometry of the tip turn 58. A more even pressure distribution occurs that allows for less pressure losses through the radial coolant cavities 44, 46.

Cooling fluid Cf may be sent through the first forward direction cavity 44*a* of the leading edge circuit 22 and the first aft direction cavity 46*a* of the trailing edge circuit 24. The cooling flow split between the leading edge circuit 22 and the trailing edge circuit 24 may be adjusted to achieve more uniform metal temperatures within the blade 10. The adjustment may be in the form of varying the thickness of the multiple channels, adjusting the length of the multiple channels, or the like. There may also be regenerative cooling for the platform 38 through the cooling circuits by routing some of the cooling air from the serpentine cooling circuit to the platform 38 cooling and then returning to the serpentine cooling circuit.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

What is claimed is:

1. A turbine rotor airfoil comprising:

a leading edge and a trailing edge joined by a pressure side and a suction side, a tip end, and a radially opposite root end, wherein the tip end designates a radially outward position and the root end designates a radially inward position; and at least two multiple pass serpentine flow cooling circuits with radial coolant cavities formed within the airfoil to provide cooling for the airfoil comprising;

a leading edge circuit comprising forward direction cavities comprising at least a first forward direction cavity located within the airfoil and a second forward direction cavity forward along a chordal axis from the first forward direction cavity, wherein the leading edge circuit flows forward with at least two substantially 180-degree turns at the tip end and the root end of the airfoil providing at least a penultimate forward direction cavity and a last forward direction cavity, wherein the last forward direction cavity is located along the leading edge of the airfoil; and a trailing edge circuit comprising aft direction cavities comprising at least a first aft direction cavity located aft of the first forward direction cavity, wherein the trailing edge circuit flows aft with at least two substantially 180-degree turns at the tip end and the root end of the airfoil providing at least a penultimate aft direction cavity (46*d*) and a last aft direction cavity, wherein the last aft direction cavity is located along the trailing edge of the airfoil;

wherein the 180-degree turn into an entrance of a second radial coolant cavity from an exit of a first radial coolant cavity narrows from a consistent cavity width and then expands out back to the consistent cavity width downstream, wherein a diameter of a space between the first radial coolant cavities and the second radial coolant cavity expands at the entrance of the second radial coolant cavity and then reduces to a consistent diameter of space that is maintained between the first radial coolant cavity and the second radial coolant cavity the rest of the first radial coolant cavity and the second radial coolant cavity path.

2. The blade according to claim 1, wherein the diameter of the space between the first radial coolant cavities and the second radial coolant cavity at the entrance into the second radial coolant cavity is twice the diameter than near the root end of the first radial coolant cavities and the second radial coolant cavity.

3. The blade according to claim 1, wherein the transition from a maximum diameter length to the consistent length diameter downstream occurs over an angle less than approximately fifteen degrees from the maximum diameter length.

4. The blade according to claim 1, further comprising a cooling fluid entrance at the root end of the first radial coolant cavities.

5. The blade according to claim 1, wherein the first radial coolant cavities is the first forward direction cavity and the second radial coolant cavities is the second forward direction cavity.

6. A method for reducing pressure loss in a forward direction cavity within a blade for a turbine engine, the method comprising:

reducing a cavity width at an entrance of a radially inward flowing cavity of a forward direction leading edge circuit of at least two multiple pass serpentine flow cooling circuits formed within the airfoil;

increasing the diameter of the space between the radially inward flowing cavity and a radially outward flowing cavity at the point of the entrance into the radially inward flowing cavity to a maximum diameter length.

7. The method according to claim 6, wherein the diameter of the space between the radially outward flowing cavity and the radially inward flowing cavity at the entrance into the radially inward flowing cavity is twice the diameter than near the root end of the radially outward flowing cavity and the radially inward flowing cavity.

8. The method according to claim 6, wherein the transition from the maximum diameter length to the consistent length diameter downstream occurs over an angle less than approximately fifteen degrees from the maximum diameter length.

9. The method according to claim 6, wherein the blade further comprises a cooling fluid entrance at the root end of the radially outward flowing cavity.

* * * * *